US005849363A

United States Patent [19]

Yapel et al.

[11] Patent Number: 5,849,363

[45] Date of Patent: Dec. 15, 1998

[54] APPARATUS AND METHOD FOR MINIMIZING THE DRYING OF A COATING FLUID ON A SLIDE COATER SURFACE

[75] Inventors: Robert A. Yapel, Oakdale; Aparna V. Bhave, Woodbury; Timothy J. Edman, Stillwater, all of Minn.

[73] Assignee: Minnesota Mining and Manufacturing Company, St. Paul, Minn.

[21] Appl. No.: 786,157

[22] Filed: Jan. 21, 1997

[51] Int. Cl.[6] ..... B05D 1/30; B05D 1/36

[52] U.S. Cl. ..... 427/420; 427/402; 118/302; 118/412; 118/DIG. 4

[58] Field of Search ..... 427/402, 420; 118/411, 412, DIG. 4, 302

[56] References Cited

U.S. PATENT DOCUMENTS

| | | | |
|---|---|---|---|
| 2,681,294 | 6/1954 | Beguin . | |
| 2,761,419 | 9/1956 | Mercier et al. . | |
| 3,289,632 | 12/1966 | Barstow . | |
| 3,596,275 | 7/1971 | Sweet | 346/1 |
| 3,690,917 | 9/1972 | Hershoff et al. . | |
| 3,735,729 | 5/1973 | Bird . | |
| 4,001,024 | 1/1977 | Dittman et al. . | |
| 4,113,903 | 9/1978 | Choinski . | |
| 4,287,240 | 9/1981 | O'Connor . | |
| 4,292,349 | 9/1981 | Ishiwata et al. . | |
| 4,313,980 | 2/1982 | Willemsens . | |
| 4,335,672 | 6/1982 | Krussig . | |
| 4,416,214 | 11/1983 | Tanaka et al. . | |
| 4,525,392 | 6/1985 | Ishizaki et al. . | |
| 4,545,321 | 10/1985 | Bassa . | |
| 4,569,863 | 2/1986 | Koepke et al. . | |
| 4,572,849 | 2/1986 | Koepke et al. . | |
| 4,623,501 | 11/1986 | Ishizaki . | |
| 4,828,779 | 5/1989 | Hiraki et al. . | |
| 4,863,765 | 9/1989 | Ishizuka | 427/420 |
| 4,877,639 | 10/1989 | Willemsens et al. . | |
| 4,976,999 | 12/1990 | Ishizuka . | |
| 4,977,852 | 12/1990 | Ishizuka . | |
| 5,380,365 | 1/1995 | Hirsburg . | |
| 5,382,504 | 1/1995 | Shor et al. . | |
| 5,389,150 | 2/1995 | Baum et al. . | |
| 5,434,043 | 7/1995 | Zou et al. . | |
| 5,439,708 | 8/1995 | Tsujimoto et al. . | |
| 5,593,734 | 1/1997 | Yuan et al. . | |
| 5,641,544 | 6/1997 | Melancon et al. | 427/331 |
| 5,683,750 | 11/1997 | Hoff et al. . | |

FOREIGN PATENT DOCUMENTS

| | | |
|---|---|---|
| 0552653 | 7/1993 | European Pat. Off. . |
| 0622667 | 11/1994 | European Pat. Off. . |
| 0627661 | 12/1994 | European Pat. Off. . |
| 2-311849 | 12/1990 | Japan . |

OTHER PUBLICATIONS

Gutoff, "Simplified Design of Coating Die Intervals," *Journal of Imaging Science and Technology*, 1993, 37(6), 615–627.

E. D. Cohen and E. B. Gutoff, *Modern Coating and Drying Technology*, VCH Publishers (1992) pp. 9, 119–120, 142–145, 156–159, 162–163.

*Primary Examiner*—Shrive Beck
*Assistant Examiner*—Michael Barr
*Attorney, Agent, or Firm*—William K. Weimer

[57] ABSTRACT

A method for use with a slide coater including preparing a first coating fluid and flowing the first coating fluid down at least a first slide surface of a slide coater when coating of the first coating fluid onto the substrate is desired and flowing a minimizing fluid down the at least first slide surface when coating of the first coating fluid onto the substrate is not desired. The minimizing fluid has a composition which minimizes drying of the first coating fluid on the at least first slide surface. This invention applies to imaging, data storage, and other media.

19 Claims, 7 Drawing Sheets

——— Constant Shim Height
------- Chamfered Shim Height

APPARATUS AND METHOD FOR MINIMIZING THE DRYING OF A COATING FLUID ON A SLIDE COATER SURFACE

FIELD OF THE INVENTION

The present invention relates to a method for minimizing the drying of a coating fluid on a slide coater surface, wherein the coating is intended to create, for example, a photothermographic, thermographic, or photographic element, data storage element (e.g., a magnetic computer tape and floppy or rigid disks or diskettes, and the like), or other material which is susceptible to such drying.

BACKGROUND OF THE ART

A construction of a known photothermographic dry silver film or paper product 10 is shown in FIG. 1. This construction can be created by coating a plurality of layers onto a substrate. One of the layers is a photothermographic emulsion layer 14 made up of a photosensitized silver soap in a binder resin which can include toners, developers, sensitizers and stabilizers. To improve adhesion of the photothermographic emulsion layer 14 to the substrate, a primer layer 16 can be positioned between them. A topcoat layer 12 can be positioned above the photothermographic emulsion layer 14 and can be made up of a mar-resistant hard resin with toners and slip agents. The substrate 18 can be a paper-based substrate or a polymeric film-based substrate. An antihalation layer 20 can be applied to the surface of the substrate 18 opposite the surface on which the primer, photothermographic emulsion, and topcoat layers 16, 14, 12 can be positioned. The compositions of layers 16, 14 and 12 are chosen for product performance reasons, and components comprising adjacent coating layers could be incompatible.

It is desirable to determine how to coat the fluids that form (i.e., the precursors) for the primer, photothermographic, and topcoat layers 16, 14, 12, respectively, using a simultaneous multilayer coating method. Slide coating, as described in U.S. Pat. No. 2,761,419 (Mercier et al., 1956) and elsewhere (see E. D. Cohen and E. B. Gutoff, *Modern Coating and Drying Technology*, VCH Publishers, 1992), is a method for multilayer coating, i.e., it involves coating a plurality of fluid layers onto a substrate. The different fluids comprising the multiple layer precursors flow out of multiple slots that open out onto an inclined plane. The fluids flow down the plane, across the coating gap and onto an upward moving substrate. It is claimed that the fluids do not mix on the plane, across the coating gap, or on the web, so that the final coating is composed of distinct superposed layers. A number of developments have been reported in this area regarding the use of slot steps, chamfers, and have been described in literature (see E. D. Cohen and E. B. Gutoff, op. cit.).

The application of multilayer slide coating as described in the above references to the coating of a product such as is described in FIG. 1, that involves coating layers comprising incompatible solutes in miscible solvents, can lead to a problem of "strikethrough" that is described herewith. Incompatible solutes are solutes that do not mix in some or all concentration ranges, whereas miscible solvents are solvents that mix in any proportion.

Occasionally during coating, a disturbance causes one of the coating layers above the bottom-most coating layer to penetrate through the bottom-most coating layer to the slide surface. When the solute of the coating layer(s) above the bottom-most coating layer is sufficiently incompatible with the solute of the bottom-most layer, the penetrating coating layer attaches to slide surface 53 and is not quickly self-cleaned by the bottom-most coating layer. This phenomenon is referred to as strikethrough. (The term "self-clean" means the process which occurs when the flow of the bottom-most coating layer (or the bottom-most coating layer and one or more adjacent coating fluid layers) cleans off the penetrant coating fluid layer that sticks to the slide surface.)

When strikethrough occurs, the flow of the coating fluid down the slide surface 53 is disturbed which can lead to streaking defects in the coated product. Streaking defects can, in turn, reduce product quality to the point where the final product is outside specifications and cannot be used.

Another problem encountered during multilayer slide coating of product constructions involving different solvents in different layers is that the interdiffusion of solvents between these layers can cause phase separation of one or more solutes within one or more layers. This phase separation can result in the inability to coat such a construction using a multi-layer coating technique due to formation of defects such as streaks or fish-eyes, or due to a disruption of flow and the intermixing of separate fluid layers.

Traditional slide coating, as described in U.S. Pat. No. 2,761,419 (Mercier et al., 1956), is restricted to coating solutions that are relatively low in viscosity. The use of a "carrier layer" in slide coating was first described by U.S. Pat. No. 4,001,024 (Dittman and Rozzi, 1977), where the authors claimed an improvement over a previously-described method of slide coating "by coating the lowermost layer as a thin layer formed from a low viscosity composition and coating the layer above the lowermost layer as a thicker layer of higher viscosity." Furthermore, the authors state that due to the vortical action of the coating bead that is confined within the two bottom layers, intermixing occurs between the two bottom layers, and, therefore, the coating compositions of these two layers must be chosen such that the interlayer mixing is not harmful to the product. However, his patent does not address strikethrough or phase separation.

U.S. Pat. No. 4,113,903 (Choinski, 1978) teaches that a low viscosity carrier layer tends to be unstable "in the bridge between the coater lip and the web in the bead formed with a bead coater" and can limit the web speed at which the method can be applied. To overcome this problem, Choinski suggests use of a non-Newtonian pseudoplastic liquid as the carrier, such that it has a high viscosity on the slide and in the bead where the shear rate is low, and a low viscosity near the dynamic contact line where the shear rate is high. In U.S. Pat. No. 4,525,392 (Ishizaki and Fuchigami, 1985), it is further specified that the non-Newtonian (or shear thinning) carrier layer viscosity should be within 10 cp of the next layer at low shear rates, but lower at high shear rates. However, these patents do not address strikethrough or phase separation.

Interlayer mixing between the bottom two layers "caused by a whirl formation in the meniscus" is cited as a limitation of the above patents, and a method of overcoming this interlayer mixing by adjustment of coating gap is described in U.S. Pat. No. 4,572,849 (Koepke et al., 1986). This method also employs a low viscosity accelerating layer as the lowermost layer over which other higher viscosity layers can be arranged. A slightly different layer arrangement is also described where a low viscosity spreading layer is used as the uppermost layer in addition to the lowermost low viscosity accelerating layer. The same arrangement is used for curtain coating in related patent U.S. Pat. No. 4,569,863 (Koepke et al., 1986). However, neither patent addresses the problem of strikethrough or phase separation that occurs on the slide surface.

U.S. Pat. No. 4,863,765 (Ishizuka, 1988) teaches that using a thin layer of distilled water as carrier allows high coating speeds and also eliminates mixing between the two lowermost layers. In related patents U.S. Pat. No. 4,976,999 and U.S. Pat. No. 4,977,852 (Ishizuka, 1990a and 1990b), the carrier slide construction with water as carrier (as described in U.S. Pat. No. 4,863,765) is used, and it is noted that streaking is reduced by using smaller slot heights for the carrier layer and that bead edges are stabilized by extending the width of the carrier layer beyond the width of the other layers coated above the carrier. This patent also does not address strikethrough or phase separation.

In summary, U.S. Pat. Nos. 4,001,024, 4,113,903, and 4,525,392 require that the composition of the two bottom layers be adjusted such that interlayer mixing between these layers in the coating bead not lead to defects in the product. U.S. Pat. No. 4,572,849 (and related U.S. Pat. No. 4,569,863), while not restricting layer composition, restricts the coating gap to the range 100 $\mu$m–400 $\mu$m. Likewise, U.S. Pat. Nos. 4,863,765, 4,976,999 and 4,977,852, while not specifically requiring a composition adjustment, are restricted to aqueous solutions by use of distilled water as carrier. However, the problem of strikethrough that occurs with a product construction as shown in FIG. 1 is not addressed by these patents. In other words, the prior art as described in the above patents does not disclose the necessary criteria that will allow strikethrough-free manufacture of a product such as a photothermographic element that is illustrated in FIG. 1. Furthermore, these patents do not address the problem of phase separation that can prevent the use of a multi-layer coating technique in the manufacture of a product, such as the product illustrated in FIG. 1.

It would be desirable to simultaneously apply such incompatible solutes in miscible solvents using multilayer coating techniques such as slide coating without occurrence of strikethrough or phase separation. It would also be desirable to continuously coat such compositions at wide coating gaps (greater than 400 $\mu$m) to allow for coating over splices in the substrate without interruption in order to maximize productivity. Moreover, it would be desirable to apply such layers from either organic solvent or aqueous medium, as required by product composition.

Still further, it would be desirable to reduce the waste of coating fluid(s) that results when it becomes necessary to interrupt the coating process. When slide coating is begun, a uniform, streak-free flow of each of the fluid layers on the slide surface is established. This is often a careful, tedious, and time-consuming process. Only after streak-free, stable, uniform fluid flows are established is the coating die moved toward the moving web to form a coating bead and thus transfer the coating to the web. When coating must be interrupted during the normal course of coating operations, the coating die is retracted from the web.

Often when this is done, the flow of coating fluids is continued to insure that pumping and streak-free, stable, uniform fluid flows are maintained. The coating fluid(s) are collected by a vacuum box trough or drain trough and drained to a scrap receptacle. This has the disadvantage of wasting coating fluid(s).

Alternatively, to minimize waste of coating fluid(s) during prolonged pauses in coating, the flow of coating fluid(s) is often completely stopped and some covering such as tape is placed over the coating die slots to reduce drying. Unfortunately, this leads to contamination of the slide and slots by adhesive, particles, fibers, etc., and is only marginally effective in preventing dry-out and/or coagulation in the slots. When coating is resumed, the tedious process of streak elimination must be repeated, and streak-free, stable, uniform fluid flows must be reestablished. This can, again, result in waste of coating fluid(s) and loss of production time.

Yet another alternative is to reduce rather than completely stop the flow of coating fluid(s). When this method is used with volatile organic solvent based coatings, undesirable dry-out and/or coagulation of the coating fluid(s) on the slide surface and in the slide slots still occurs due to the rapid evaporation of the volatile organic solvent. Again, when coating is resumed streak elimination must be repeated, and stable fluid flows must be reestablished.

It would be desirable to find a method that avoids either the need for continuous flow of the coating fluid, or streaks, dryout, etc., that can result during necessary interruptions to the coating process. This desire and other desires noted herein extend beyond the process of making photothermographic, thermographic, photographic, and data storage materials (such as magnetic storage media) to the preparation of other coated materials whose production involves similar problems.

SUMMARY OF THE INVENTION

The invention described here is an apparatus and/or a method for use with a slide coater. The method can include the step of flowing a first coating fluid down at least a first slide surface of a slide coater when coating of the first coating fluid from the at least first slide surface onto a substrate is desired. Another step can involve flowing a minimizing fluid down the at least first slide surface. The minimizing fluid has a composition which minimizes drying of the first coating fluid on the at least first slide surface. The apparatus can include means for accomplishing the method steps noted above.

Other aspects, advantages, and benefits of the present invention are apparent from the drawings, detailed description, examples, and claims.

BRIEF DESCRIPTION OF THE DRAWINGS

The foregoing advantages, construction, and operation of the present invention will become more readily apparent from the following description and accompanying drawings.

DETAILED DESCRIPTION OF PREFERRED EMBODIMENTS

Slide Coating Apparatus

Figure 2:
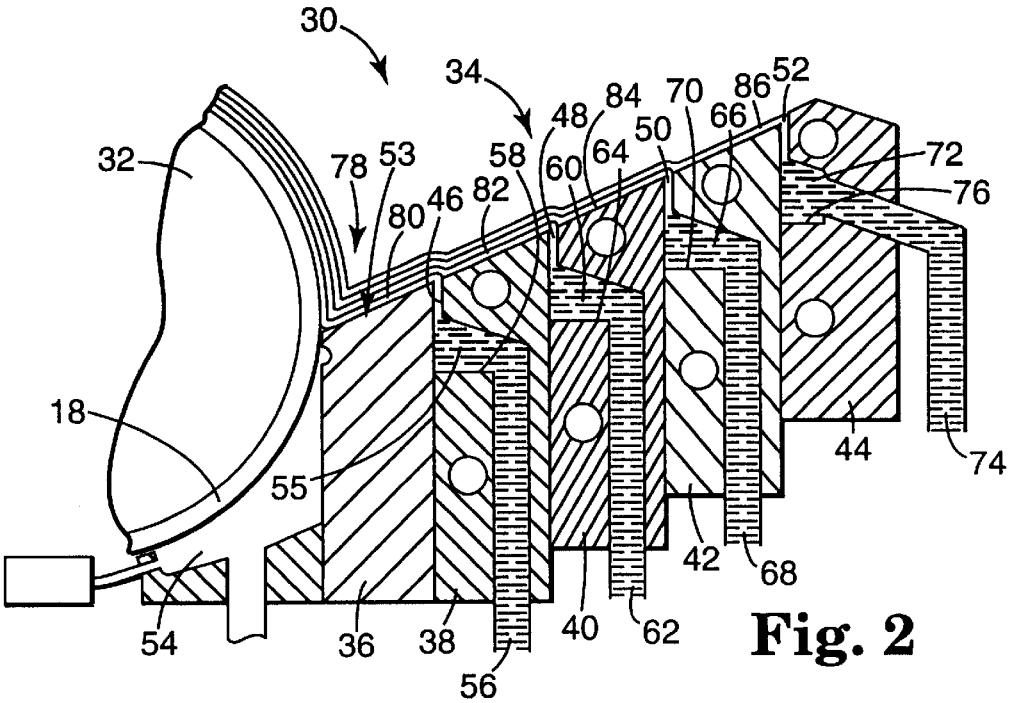
FIG. 2 is a side sectional view of a slide coater in accordance with the present invention.
Figure 3:
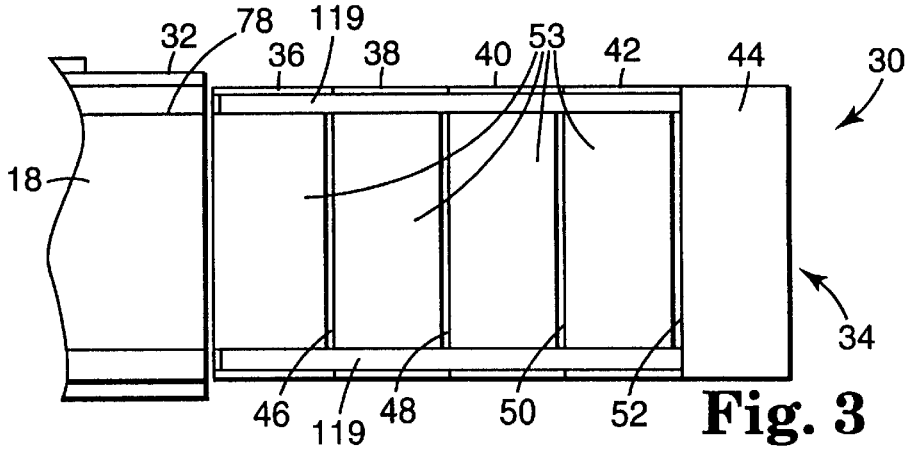
FIG. 3 is a partial top view of the slide coater shown in FIG. 2.

FIGS. 2 and 3 illustrate a slide coating apparatus 30 generally made up of a coating back-up roller 32 for the substrate 18, and a slide coater 34. The slide coater 34 includes five slide blocks 36, 38, 40, 42, 44 which define four fluid slots 46, 48, 50, 52 and a slide surface 53. The first slide block is adjacent to the coating back-up roller 32 and includes a vacuum box 54 for adjusting the vacuum level by the slide coating apparatus 30. The vacuum box serves to maintain a differential pressure across the coating bead, thereby stabilizing it.

A first fluid 55 can be distributed to the first slot 46 via a first fluid supply 56 and a first manifold 58. A second fluid 60 can be distributed to the second slot 48 via a second fluid supply 62 and a second manifold 64. A third fluid 66 can be distributed to the third fluid slot 50 via a third fluid supply 68 and a third fluid manifold 70. A fourth fluid 72 can be distributed to the fourth fluid slot 52 via a fourth fluid supply 74 and a fourth fluid manifold 76. This embodiment allows for the creation of up to a four-layer fluid construction 78 including a first fluid layer 80 (a.k.a., a carrier layer), a second fluid layer 82, a third fluid layer 84, and a fourth fluid layer 86. Additional slide blocks can be added for the introduction of additional fluid layers, as required for product performance or ease of operability.

The fluid manifolds 58, 64, 70 and 76 are designed to allow uniform width-wise distribution out of fluid slots 46, 48, 50, 52, respectively. This design is specific to the choice of slot height H (illustrated in FIG. 4) for the slots 46, 48, 50, 52. The slot height H is made sufficiently small such that the pressure drop in the slot is much higher than the pressure drop across the manifold (without causing undue problems of non-uniformity due to machining limitations or bar deflection due to excessive pressure in the die slot). This ensures that the fluid distributes uniformly in the slot. It is known that slot heights are made smaller when lower flow rates are desired.

The design of the fluid manifold can also be made specific to the rheology of the fluid that it will carry, taking into account material properties such as but not limited to zero-shear viscosity, the power law index, fluid elasticity, and extensional behavior. The fluid supply can be located either at the end of the fluid manifold (end-fed design) or at the center of the fluid manifold (center-fed design). The principles of manifold design are also well-documented in literature (see, for example, Gutoff, "Simplified Design of Coating Die Internals," *Journal of Imaging Science and Technology,* 1993, 37(6), 615–627) and could be used for all die-fed coating processes such as but not limited to slide, extrusion, and curtain coating. Further details of a preferred manifold design are noted later within this disclosure.

Figure 4:
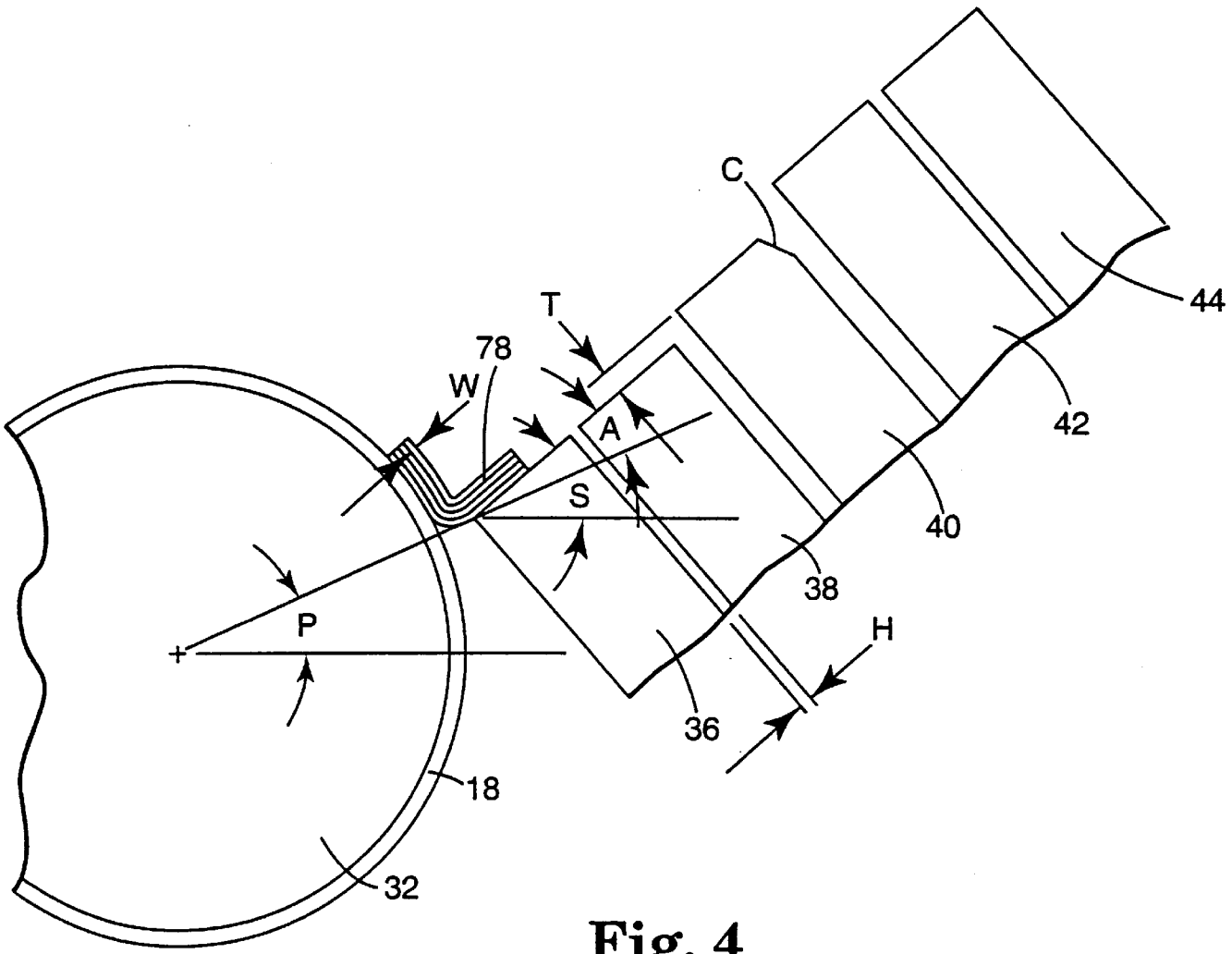
FIG. 4 is a partial side sectional view of the slide coater shown in FIG. 2.

The slide blocks 38, 40, 42, 44 can be configured to have specific slot heights H as depicted in FIG. 4, chosen amongst other reasons to minimize pressure in the die manifolds and to overcome problems of non-uniformity due to machining limitations. The slot heights typically used range between 100–1500 $\mu$m. The slide blocks 38, 40, 42, 44 can also be arranged with a level offset so as to result in slot steps T, also depicted in FIG. 4. These steps can aid the uniform flow of fluid down the slide surface 53 by minimizing the possibility of flow separation and fluid recirculation zones that can lead to streaking and other product defects. These slot steps can range from 100–2000 $\mu$m in height. The use of such steps is well-documented. Another method of minimizing the occurrence of flow separation on the slide surface 53 is by machining chamfers C on the downstream side of a fluid slot, as depicted in FIG. 4, and could also be used in the embodiment of slide coating as described in this application.

In the machining of the slide blocks 36, 38, 40, 42, 44, the finish of the block edges that form the edges of the fluid slots 46, 48, 50, and 52 are important, as is also the front edge of the front block 36 that is adjacent to backup roller 32. The presence of nicks, burrs or other defects on these edges can lead to streaking defects in the product. In order to avoid such defects, the edges are polished to a finish of less than 8 microinches (0.02 $\mu$m). Details regarding the procedure for finishing the die edges are disclosed in pending U.S. patent application Ser. No. 08/462,807 now abandoned (Milbourn et al., filed Jun. 5, 1995) and pending U.S. patent application Ser. No. 08/464,957 now U.S. Pat. No. 5,655,948 (Yapel et al., filed Jun. 5, 1995) which are both hereby incorporated by reference.

FIG. 4 also illustrates the orientation of the slide coater 34 relative to the back-up roller 32, including the position angle P, attack angle A, and the slide angle S. (The slide angle S is the sum of the position angle P and the attack angle A.) A negative position angle P is preferred so as to allow for increased wrap on the back-up roller and thereby greater stability for the coating operation. However, the method could also be used with a zero or positive position angle. The slide angle S determines the stability of the flow of fluids down the inclined slide plane. A large slide angle S can lead to the development of surface wave instabilities and consequently coating defects. The slide angle is typically set in the range from slightly greater than zero to 45°. The distance between the slide coater 34 and the roller 32 at the point of closest approach is known as the gap G. The wet thickness W of each layer is the thickness on the surface of the coated substrate 18 substantially far away from the coated bead, but close enough before appreciable drying has occurred.

Figure 5:
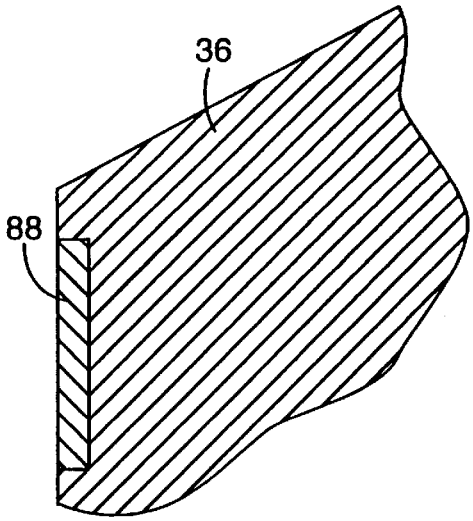
FIG. 5 is a partial side sectional view of an embodiment of the slide coater shown in FIG. 2.
Figure 6:
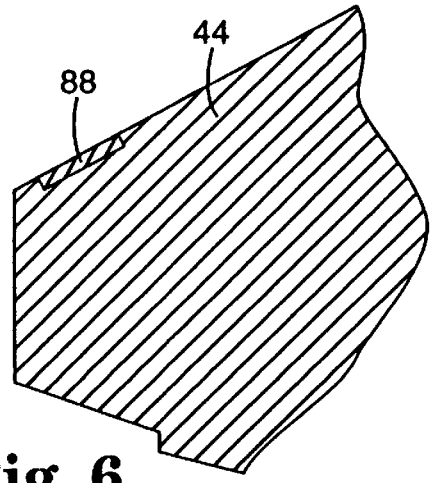
FIG. 6 is a partial side sectional view of an embodiment of the slide coater shown in FIG. 2.

Other portions of the slide coating apparatus 30 deserve further discussion. FIGS. 5 and 6 illustrate portions of the slide coater which include durable, low surface energy portions 88. These portions 88 are intended to provide the desired surface energy properties to specific locations to uniformly pin the coating fluid to prevent build-up of dried material. Details regarding the process of making the durable, low surface energy portions 88 are disclosed in pending U.S. patent application Ser. No. 08/659,053 (Milbourn et al., filed May 31, 1996), which is hereby incorporated by reference.

Figure 7:
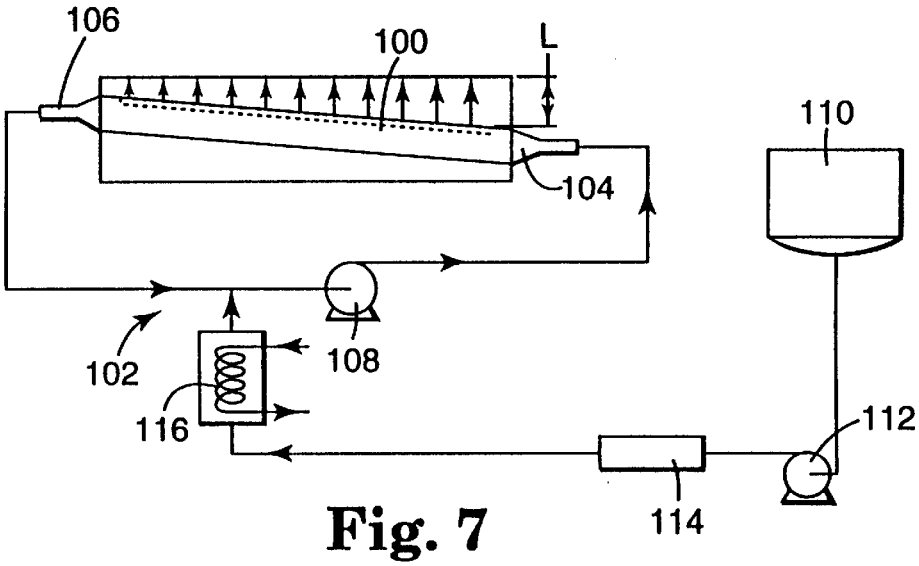
FIG. 7 is a schematic view of an embodiment of the slide coater shown in FIG. 2 and additional components.

FIG. 7 illustrates a particular type of end-fed manifold 100 and a recirculation loop 102. Note that the manifold 100 is shown as being inclined towards the outlet port 106 such that the depth of the slot L decreases from the inlet port 104 to the outlet port 106. The incline angle is carefully adjusted to take into account the pressure drop in the fluid as it traverses from the inlet port 104 of the manifold 100 to the outlet port 106 to ensure that the width-wise fluid distribution at the exit of the slot is uniform. With the illustrated manifold design, only a portion of the fluid that enters the manifold 100 leaves through the fluid slot (such as slots 46, 48, 50, or 52), while the remainder flows out through the outlet port 106 to the recirculation loop 102. The portion which flows through the outlet port 106 can be recirculated back to the inlet port 104 by a recirculation pump 108. The recirculation pump 108 can receive fresh fluid from a fluid reservoir 110 and fresh fluid pump 112. A fluid filter 114 and heat exchanger 116 can be included to filter and heat or cool the fresh fluid before it mixes with the recycled fluid. In this case, the same principles that apply to the design of end-fed manifolds are still applicable. The manifold design, i.e., the cavity shape and angle of incline, however, depends not only on the choice of slot height and fluid rheology, but on the percent recirculation used. The use of a similar recirculation loop for preventing agglomeration in the manifold during coating of highly shear-thinning magnetic materials is disclosed in U.S. Pat. No. 4,623,501 (Ishizaki, 1986).

Figure 8:
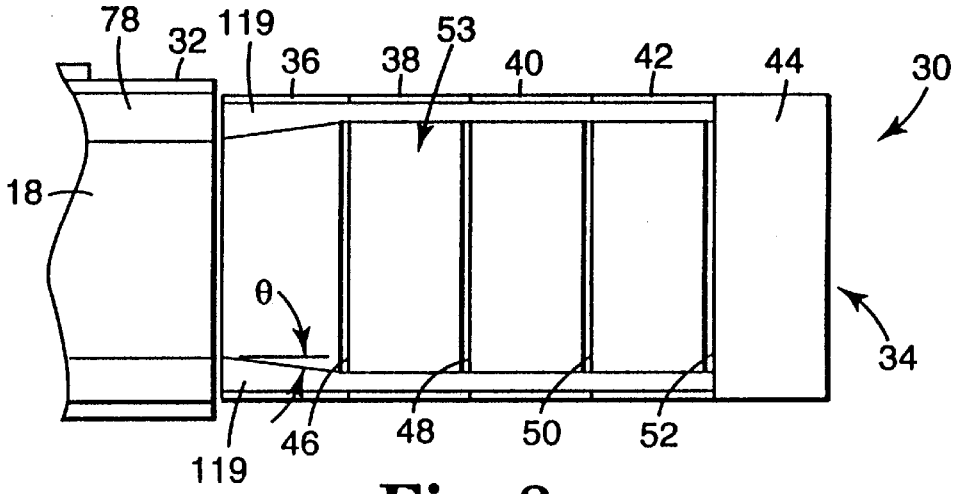
FIG. 8 is a partial top view of an embodiment of the slide coater shown in FIG. 2.

The flow of fluid down the slide surface 53 is aided by the use of edge guides 119 at each edge of the surface, as shown in FIG. 3 (and FIG. 8). The edge guides 119 serve to pin the solution to the solid surface and result in a fixed width of coating and also stabilize the flow of fluid at the edges. The particular type of edge guide 119 illustrated in FIG. 3 is commonly known in the coating art. Note that the edge guides are straight, and direct flow perpendicular to the slots 46, 48, 50, 52 over the slide surface. The edge guides 119 can be made of one material including metals such as steel, aluminum, etc.; polymers such as polytetrafluoroethylene (e.g., Teflon™), polyamide (e.g., Nylon™), poly(methylene oxide) or polyacetal (e.g., Delrin™), etc.; wood; ceramic, etc., or can be made of more than one material such as steel coated with polytetrafluoroethylene.

The edge guides 119A can be of a convergent type, as illustrated in FIG. 8. The angle of convergence θ can be between 0° and 90°, with 0° corresponding to the case of straight edge guides of FIG. 3. The angle θ can be chosen for increased stability of the coating bead edges by increasing coating thickness at the bead edges relative to the center. In other embodiments, the edge guides can include durable, low surface energy surfaces or portions as described previously. In addition, the edge guides can be profiled to match the fluid depth profile on the slide surface as described in pending U.S. patent application Ser. No. 08/657,842 (Yapel et al., filed May 31, 1996).

A cover or shroud over the slide coater 34 can be used (not shown). An example of such a cover or shroud is described in detail in pending U.S. patent application Ser. No. 08/641,407 now U.S. Pat. No. 5,725,665 (Yapel et al., filed Apr. 30, 1996), which is hereby incorporated by reference.

Method of Multilayer Slide Coating

Figure 1:
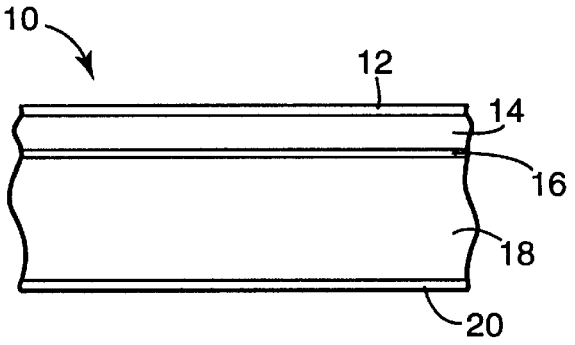
Fig. 1 Prior Art
FIG. 1 is a schematic front view of a construction of a known photothermographic element.

Using slide coating apparatus 30, a method has been developed to effectively coat, in a single pass, an organic solvent-based coating which, when dried (or otherwise solidified), creates the element 10 shown in FIG. 1 (except for antihalation layer 20). This method is especially effective when one or more of the carried fluid layers 82, 84, 86 contains dispersed or dissolved phases that are incompatible with the constituents of the first (or carrier) layer 80 and function by preventing or minimizing the intermixing of the fluid layers on the surface of the slide.

As used herein, incompatibility of the dispersed or dissolved phases means that the coating fluid layers that contain these substantially different dispersed or dissolved phases do not readily mix, although the solvents comprising the fluid layers (either the same or different) are miscible and readily interdiffuse. An example of such a system is a multilayer coating where the first layer comprises Vitel™ PE2200 dissolved in MEK and the second layer comprises Butvar™ B-79 dissolved in MEK. Upon coating, this system is prone to strikethrough.

One counter-example where strikethrough is not a problem is provided by conventional silver halide photographic constructions where all layers contain a substantial gelatin component with water as the solvent. A second counter-example where strikethrough is not a problem is provided by two solutions or dispersions that differ only in solvent content (i.e., concentration) but are otherwise identical.

Furthermore, as used herein, "phase separation" means that an interdiffusion of the different solvents in different fluid layers causes one or more of the solutes in one or more of the layers to spontaneously form a separate phase by the phenomenon of spinodal decomposition.

In systems that are prone to strikethrough, the disruption of the interface between the carrier layer and various carried layers eventually leads to one or more of the carried fluid layers penetrating and sticking to the surface of the slide and causing excessive streaking and waste in the manufacture of the desired product (i.e., strikethrough). We have found that this phenomena of strikethrough can be minimized or prevented in one of two ways:

(1) by preventing the disruption of the interface due to naturally occurring disturbances, or (2) by sufficiently slowing the penetration of the carried fluid layers to the surface of the slide with respect to the average time required for coating and drying.

A preferred additional aspect of the invention is the ability to "self-clean," that is, the flow of the bottom-most coating layer (or the bottom-most coating layer and one or more adjacent coating fluid layers) cleans off the penetrant coating fluid layer that sticks to the slide surface. These methods of preventing strikethrough are described in the embodiments given below.

One embodiment of this method involves a first or carrier layer 80 which is more dense than upper or carried fluid layers 82, 84, 86 and which has a viscosity that is sufficiently low to allow coating at high speeds. Any of carried layers 82, 84, 86 can be incompatible with first layer 80. Layers 82 and 80 can be incompatible, as can layers 84 and 82 and layers 86 and 84.

A further embodiment of the method involves a first layer 80 having a greater density than second layer 82, which has a greater density than the third layer 84, which has greater density than the fourth layer 86.

A further embodiment of the method involves a layer of sufficient thickness, viscosity, or density such that a disturbance will not result in contact of the slide surface 53 by any carried layer disposed above such layer.

Another embodiment involves a low viscosity, low density, first layer (also known as a carrier layer) 80 and a second layer 82 (i.e., a first carried layer) which is self-cleaned by the first layer 80 and more dense than first layer 80 and third and fourth layers 84, 86. Layers 80 and 82 are compatible, and layer 84 and/or layer 86 can be incompatible with layer 80. A preferred embodiment involves a low viscosity, low density, first (or carrier) layer 80 and a second layer 82 (i.e., a first carried layer) that is self-cleaned by the first layer 80, and which is more dense than first layer 80 and layer 84, and where layer 84 is more dense than layer 86. Layers 80 and 82 are compatible, layers 80 and 84 can be incompatible, and layers 84 and 86 can be incompatible.

Another embodiment involves a first carried layer which has a sufficiently high viscosity and thickness such that a disturbance will not be allowed to result in contact between a carried layer 84 or 86 and the slide surface 53, thus preventing strikethrough.

In systems where phase separation can occur, particulates or gels can form within a layer leading to defects such as streaking, fish-eyes, or even a complete disruption of flow and intermixing of separate fluid layers. To avoid such phase separation, one must judiciously choose the solvents and solutes in the different layers that are to be coated using a multi-layer coating technique, such that no solute (from any layer) phase separates in the entire range of concentration encountered during the stages of coating and drying. Therefore, another embodiment of the present invention is making the proper choice of solvents within the different layers such that no solvent or combination of solvents causes phase separation in any of the layers.

While the examples shown below were carried out with fluids used to manufacture a photothermographic imaging element, the configurations and methods described herein for using slide coating apparatus 30 can be beneficial when coating other imaging materials such as thermographic, photographic, photoresists, photopolymers, etc., or even other non-imaging materials such as magnetic, optical, or other recording materials, adhesives, and the like. The configurations and methods are particularly applicable when intermixing of multiple layers of fluids is undesirable and where strikethrough is a source of significant waste.

Method of Minimizing Drying During Coating Start-up and Coating Pauses

As previously noted, a sixth slide block (not shown) can be added to those shown in FIGS. 2 and 3 and can be positioned adjacent to the fifth slide block 44. The sixth slide block allows for the introduction of a fifth fluid (not shown) that can coat over the coating surfaces of the first, second, third, fourth, and fifth slide blocks 36, 38, 40, 42, 44. The fifth fluid can be used to address the previously described problems of material waste, drying, and streaking that are encountered when it becomes necessary to interrupt the coating process. The fifth fluid can form a protective blanket over the other coating fluid(s) which minimizes, if not eliminates, drying of these coating fluids on the slide surface and edge guides. The fifth fluid can also self-clean various slide surfaces of contaminants and debris and can pre-wet the slide surface(s) before the coating fluid(s) are introduced to the slide surface(s). Such a fluid can be thought of as a "minimizing fluid" as it minimizes or reduces defects related to, for example, drying and poor wetting of the coating fluid(s), or related to the presence of contaminants or debris on the slide surface(s).

The fifth fluid can be directed down slide coater 34 when slide coater 34 is a sufficient distance from coating back-up roller 32 such that the fifth fluid does not contact back-up roller 32 or substrate 18, but flows down the front of the first slide block 36 and into the vacuum box and drain.

The fifth fluid can be composed of a solvent compatible with the solvent system of the coating fluid(s) and can be dispensed at the start-up of a coating run before the flows of the coating fluid(s) are begun; during a short pause in coating above the flows of the coating fluid(s); and alone with the flows of the coating fluid(s) turned off during a prolonged pause in coating or after a coating run has been completed. The fifth fluid can be, for example, 100 percent solvent and can be chosen to be miscible with solvents used for the coating fluid(s). It may be filtered in-line or pre-filtered so that no contaminating materials (e.g., particles, fibers) are introduced onto the coating surfaces.

When coating is begun, the flow of fifth fluid is started first to completely pre-wet and clean the coating surface of slide coater 34. The flow of coating fluid(s) are then started in order (fluid layers 1, 2, 3, 4, . . . ) and the flow of each of the fluid layers is established. The fifth fluid flow is then stopped and the coater die moved toward back-up roller 32 for pick-up of coating onto the web. Thus, the fifth fluid assists in the rapid establishment of streak free coating flows.

When coating is paused or stopped, the coating assembly is retracted from back-up roller 32, and the flow of the first, second, third, and fourth fluids 80, 82, 84, 86 is reduced or stopped to minimize the waste of coating fluid(s).

During a short pause in coating, the flow of the fifth fluid is started while the flow of coating fluid(s) is substantially reduced. The blanket of solvent lying over the coating fluid(s) on the slide surface minimizes or eliminates drying, coagulation, or particle formation within a coating fluid(s) that can cause streaks when coating is resumed. For resuming coating, the fifth fluid flow is stopped, the flow of coating fluid(s) is increased to normal levels, and the coater die is moved toward back-up roller 32 for pick-up of coating onto the web. Thus, the fifth fluid assists in the rapid re-establishment of streak free coating flows.

During a prolonged pause in coating, the flow of the fifth fluid is started while the flow of coating fluid(s) is completely stopped, leaving only the continuous flow of the fifth fluid. In this manner the entire slide surface is self-cleaned by the continuous solvent flow and the drying of any residual coating fluid(s) on various surfaces of the slide coater is minimized, if not entirely prevented. When coating operation is to be resumed, the coating fluid layers are restarted in order (fluid layers 1, 2, 3, 4, . . . ) while the fifth fluid flow is continued. After the coating flows are re-established, the fifth fluid flow is stopped and the coater die engaged to back-up roller 32 for pick-up of coating onto the web. Thus, the fifth fluid assists in the rapid re-establishment of streak free coating flows.

It should be noted that the above discussion is only illustrative. For example, if only three slots of slide coater 34 shown in FIG. 2 were required for a coating, the "minimizing" fluid (now a fourth fluid) could be dispensed from the fourth or fifth slot. Likewise, the "minimizing" fluid could instead be a third fluid which minimizes the drying of a first and second fluid. Or, the "minimizing" fluid could instead be a second fluid which minimizes the drying of a single coating fluid.

Additionally, the solvent flow system need not even be made with the same precision as the coating fluid system. Thus, the supply of the solvent layer to the surface of the slide coater can be by any suitable means. For example, solvent can be delivered to the slide surface by using spray nozzles, porous wicks, porous metal inserts, etc.

Though the use of this cleaning/wetting method is exemplified above in slide coating, it can easily be adapted to operations of curtain- and extrusion-coating.

Method of Cleaning Coating Dies

When multilayer slide coating is completed, the coating apparatus needs to be cleaned. Often this involves taking the coater apart and it is normal practice to disassemble the coating die and remove coating fluid remaining in the manifolds, slots, and on the slide surfaces, etc. The die is disassembled, cleaned, inspected, reassembled, and aligned prior to the next coating run. This is a laborious, expensive, and time-consuming task. All of the handling required presents numerous opportunities for damage to the precision coating die parts that can necessitate repair and result in delays. If damage is not found until coating has begun, product that is outside specifications and cannot be used may be produced.

Figure 9:
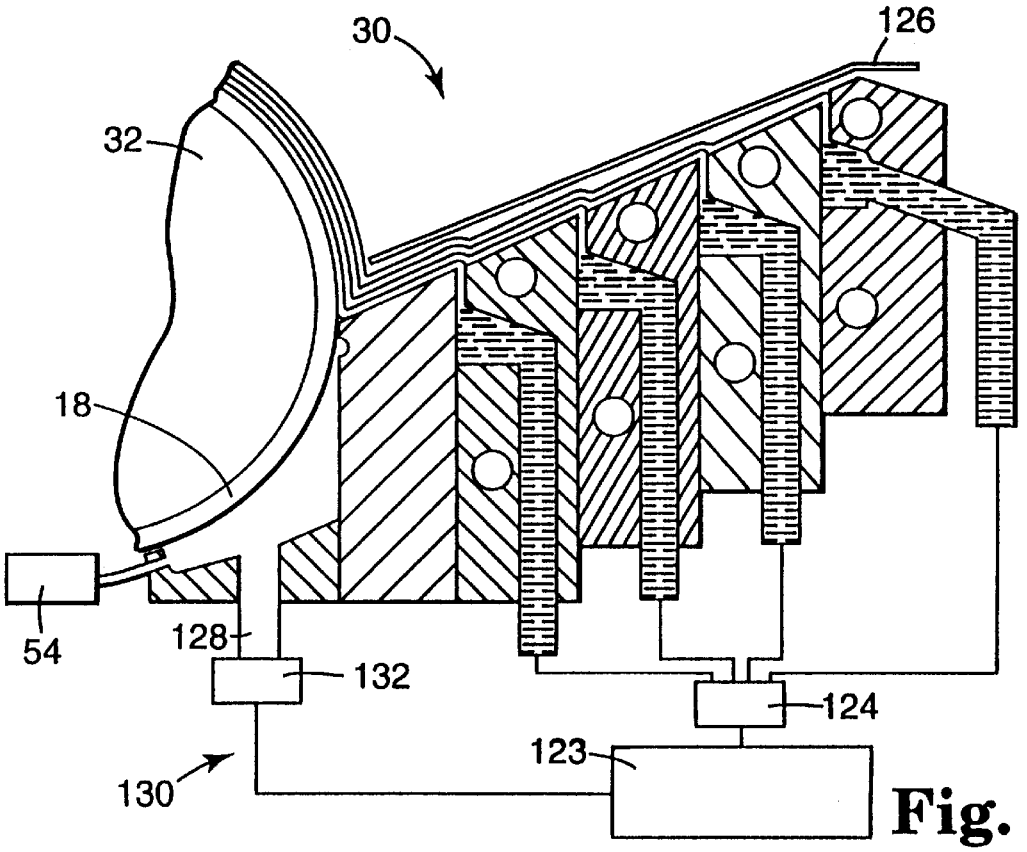
FIG. 9 is a side sectional schematic view of the slide coater shown in FIG. 2 further including means for cleaning the slide coater.

A method of clean-up following a coating run that avoids the problems of disassembly uses a cleaning construction shown in FIG. 9. The coating die can be made such that it can be switched from coating mode to cleaning mode (e.g., the coating die can be made such that it can be switched between an end-fed mode, used during coating, to a recirculation mode, used during cleaning).

Figure 10:
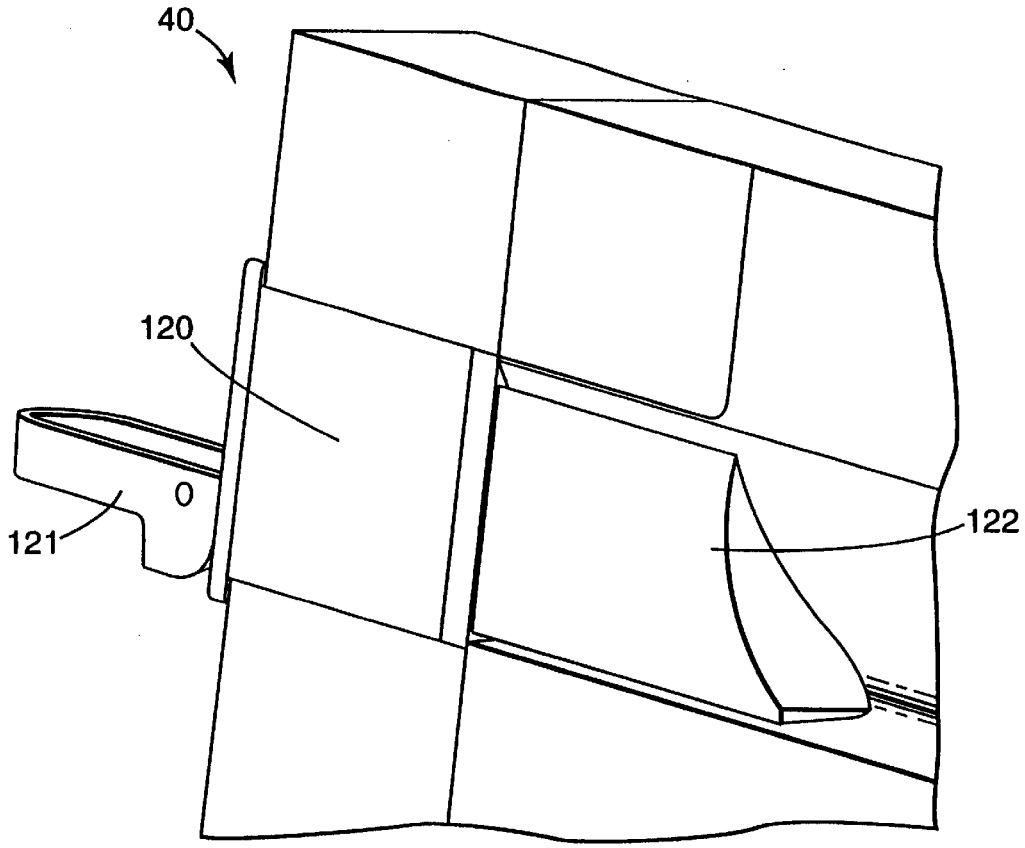
FIG. 10 is a perspective, partial, sectional view of an end of a die block and a cam used to apply pressure to an end seal in the manifold of the die slot.

This is accomplished by the use of removable, elastomeric, manifold-end seals 120 that can be compressed in place by rotating cam levers 121 (one shown to achieve sealing action), as shown in FIG. 10. Removal of the removable, elastomeric end seals 120 (within a flow-through cavity) and replacement with closed end seals (not shown) from a side end of a die block allows for the quick conversion from a recirculation (or cleaning) mode to an end-fed (or coating) mode. (FIG. 10 also shows that the end seal 120 includes a streamlined plug 122 which is useful to minimize a "dead zone" within the fluid flow path when in the coating mode.)

A tank 123 and a pump 124 force a cleaning fluid, such as a solvent (e.g., MEK), through one or more of the fluid slots at a rate possibly greater than the coating rate. A spray shield 126 placed over the slide coater 34 prevents the cleaning fluid from spraying and directs the cleaning fluid down at least a portion of the surface 53 of the slide blocks. This method involves moving the coating back-up roller 32 away from the slide coater 34 and the cleaning fluid to be removed from the surface of the slide coater 34 through a drain 128. The drain 128 can communicate with the tank 123 such that a cleaning fluid recirculation loop 130 can be formed. Optionally, a filter 132 can be included within the recirculation loop 130 to filter out the remaining liquid solute or dried solute particles.

This cleaning method can also be easily adapted to other coating methods, such as extrusion- and curtain-coating. One benefit is the reduction of damage to the coater resulting from either taking the coater apart or cleaning the coater with a damaging tool. Another benefit is repeatability, in that each coating run will begin after a consistent cleaning process. Furthermore, this cleaning method can be faster and can, therefore, represent a savings in labor cost. Finally, this cleaning method can simply be more effective than conventional bar cleaning methods.

Method of Reducing Edge Waste in Slide Coating

One problem with multilayer coatings is the formation of coating thickness variations, namely an overly thick edge-bead of coating immediately adjacent to the edge of the coatings on a substrate. This edge-bead is a problem and results in transfer of insufficiently dried coating material (at the edges) onto the coating apparatus; poor take-up on rolls; and hard-banding, blocking, and wrap-to-wrap adhesion problems in the wound roll of finished coated material. As a result a large amount of waste material must be slit from this edge-bead region of the coated substrate to afford material within product specifications.

U.S. Pat. No. 4,313,980 (Willemsens, 1982) aims to reduce or prevent the formation of beaded edges by modifying the slot lengths such that the length of the top slot is greater than the length of at least one of the other slots and is not exceeded by the length of any other slot. Willemsens further states that the preferred embodiments of his invention incorporates one or more of the following features: (a) the thickness of each layer of extra [coating] width is smaller than the thickness of each layer having less [coating] width; (b) the surface tension of the coating layer which directly contacts the web surface being coated is lower than the surface tension of that surface; and (c) the surface tension of each layer having the extra [coating] width is lower than the surface tension of each layer having the lesser [coating] width. The optimum difference in the length of the slots must be determined empirically and is dependent on the material of the surface to be coated as well as the properties of the coating fluid. It should be noted that the slot length determines the width of the coating.

U.S. Pat. No. 5,389,150 (Baum et al., 1995) describes slot inserts to control slot length to adjust the width of a coating on a slide coater. They note that a slot can be angled inward or outward from the hopper center for edge control. However, they do not distinguish from conventional slide coating where all the slots are of the same length while coating.

The present invention includes the understanding that a significantly reduced edge bead with monotonic increase in thickness to the targeted level can be best achieved by a gradual reduction of the flow in a narrow region adjacent to the ends of the slot. By employing the present invention, non-uniform coating overthickness and edge bead formation can be substantially reduced by suitably adjusting the slot height and/or the slot depth to control the flow of coating fluids at the ends of the coating slots.

Figure 11:
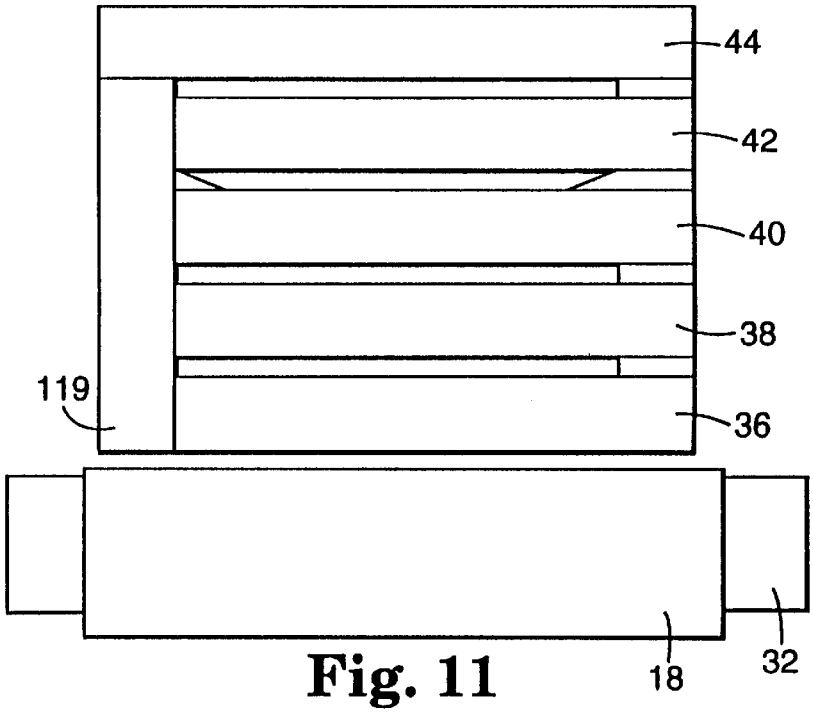
FIG. 11 is a partial top view of an embodiment of the slide coater shown in FIG. 2 including a tapered slot.

A preferred method of controlling edge-thickness of a coating is by adjusting the slot height at the ends of the slot. FIG. 11 shows a top view of the slide surface for a slide coater having four slots. The third slot height has been adjusted by adding wedge-shaped shims to provide a reduction in the coating fluid flow onto the slide near the edges. This shim can held inside the slot by friction, with the help of pins, or by any other suitable means. The location and size of the wedge-shaped shims can be adjusted such that, for example, 90–99.5 percent of the slot has a constant slot height and the remainder narrows as shown. Depending on the size of the slot, the narrowing can occur between, for example, from approximately 0.1 to 1.0 inch (2.54 to 25.4 millimeters) from the edge of the slot. It is preferable that the narrowing occur between approximately 0.2 to 0.5 inch, or even more preferably, from 0.2 to 0.3 inch.

Figure 12:
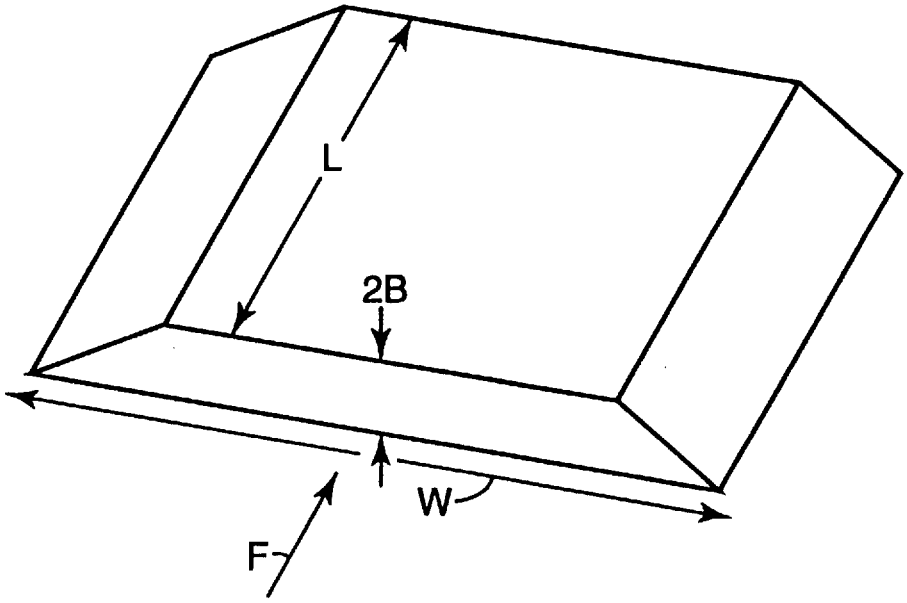
FIG. 12 is a perspective view of the tapered slot shown in FIG. 11.

It should also be noted than an advantage of the embodiment shown in FIG. 11 is that the coating fluid flow in the slot can be easily calculated as a function of the slot height. A perspective view of the "tapered" slot is depicted in FIG. 12.

Figure 14:
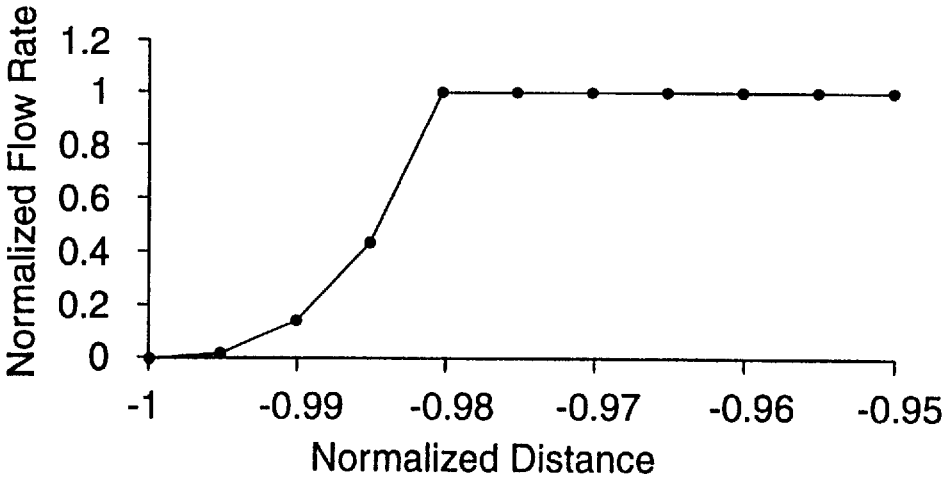
FIG. 14 is a plot of predicted normalized flow rate versus the normalized distance for a chamfered slot.

For this tapered slot, assuming (1) an infinite cavity manifold, (2) a constant viscosity (or Newtonian) fluid, and (3) the end effects extend over a very small fraction of the taper, the flow rate at any width-wise position y is given by:

$$Q(y) = \frac{\Delta P}{12\mu L}\,[f(y)]^3,$$

where f(y) is defined for the tapered slot such that $$f(y) = \left(\frac{2B}{W-V}\right)(2y+W),\ \text{for}\ -\frac{W}{2} \leqq y \leqq -\frac{V}{2}$$

$$f(y) = 2B,\ \text{for}\ -\frac{V}{2} \leqq y \leqq \frac{V}{2}$$

$$f(y) = \left(\frac{2B}{V-W}\right)(2y-W),\ \text{for}\ \frac{V}{2} \leqq y \leqq \frac{W}{2}$$

and P is the pressure, Q is the volumetric flow rate, L is the slot depth, W is the total slot length, V is the slot length with a constant slot height, 2B is the slot height in the center of the slot, and $\mu$ is the Newtonian viscosity. Other formulae exist for more rheologically complex fluids. Also, other functional forms can be inserted instead of the form for f(y) that is given above. FIG. 14 indicates the predicted normalized flow rate versus the normalized distance for this type of a chamfered slot for the case where V/W=0.98. The flow rate is reduced at the slot edges and substantially reduces the edge bead and the resultant slit waste. For instance, as shown in Examples 11 and 12 below, edge waste is reduced from about 3.5 cm to about 2 cm by the method of this invention. Likewise, the slot height can be flared outwards to reduce resistance and increase flow at the edges, if so desired.

Figure 13:
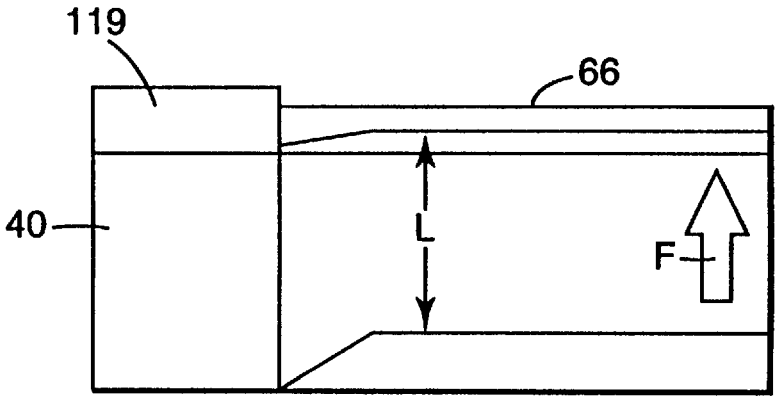
FIG. 13 is a partial side sectional view of an embodiment of a coating slot and coating surface.

Yet another method of controlling edge-thickness of a coating is by adjusting the distance from the manifold to the slide surface. This distance is also known as the slot depth L, and can be increased near the edges to reduce the flow of a fluid layer by increasing the resistance to flow near the edges, as illustrated in FIG. 13. Control of edge-thickness can also be achieved by decreasing the slot length W and reducing the slot depth L to increase fluid flow at the ends of the slot by reducing the resistance to flow there (i.e., the combination of FIGS. 11 and 13). The location and extent of the slot depth increase shown in FIG. 13 can be similar to the narrowing or tapering of the slot noted above and shown in FIGS. 11 and 12.

These methods can be used alone or in combination to give a desired coating profile. For example, a flared slot height at the slot ends (to form a bowtie appearance) may be combined with an increased (or decreased) slot depth at the edges of the slot. The combination can provide more uniformity in the final coating on the substrate. It should also be noted that in all examples described below, the final coated thickness is modified from that extruded out of the slot by the flow action on the slide and in the coating bead.

Objects and advantages of aspects of this invention will now be illustrated by the following examples, but the particular materials and amounts thereof recited in these examples, as well as other conditions and details, should not be construed to unduly limit this invention. As previously noted, aspects of the techniques described above can be applied to other coating processes including curtain coating, extrusion coating, and other die-fed coating processes.

EXAMPLES

All materials used in the following examples are readily available from standard commercial sources, such as Aldrich Chemical Co. Milwaukee, Wis., unless otherwise specified. All percentages are by weight unless otherwise indicated. The following additional terms and materials were used.

Silver homogenates were prepared as described in U.S. Pat. Nos. 5,382,504 and 5,434,043, both incorporated herein by reference, and contained 20.8% pre-formed silver soap and 2.2% Butvar™ B-79 resin for Examples 2 and 9 and contained 25.2% pre-formed silver soap and 1.3% Butvar™ B-79 resin for the Examples other than Examples 2 and 9.

Unless otherwise specified, all photothermographic emulsion layers and topcoat layers were prepared substantially as described in U.S. Pat. No. 5,541,054, incorporated herein by reference.

Butvar™ B-79 is a polyvinyl butyral resin available from Monsanto Company, St. Louis, Mo.

MEK is methyl ethyl ketone (2-butanone).

Vitel™ PE 2200 is a polyester resin available from Shell; Houston, Tex.

Pentalyn-H is a penterythritol ester of a hydrogenated natural resin and is available from Hercules, Inc.; Wilmington, Del.

Coatings were carried out on a slide coater to confirm the benefits provided by one configuration and method for using the slide coating apparatus 30.

Examples 1 and 2 are comparative examples and show a configuration and method for using the slide coating apparatus 30 (including the fluid compositions) to attempt to produce the product construction shown in FIG. 1. The composition described in Example 1 includes the first fluid layer 80 which forms the primer layer 16 (shown in FIG. 1) but which is incompatible with the second fluid 84 which forms the photographic emulsion layer 14 (shown in FIG. 1). The compositions described in Example 2 include compatible first and second fluids 80, 82 which forms the primer layer 16 (shown in FIG. 1), but which are incompatible with the third fluid 84 which forms the photothermographic emulsion layer 14 (shown in FIG. 1). The first and second layers 80, 82 are compatible in that they have the same composition, but different percent solids. In both Examples 1 and 2 strikethrough is observed.

Examples 3–10 describe coating by the method of this invention whereby strikethrough is prevented. Examples 11 and 12 illustrate the invention whereby edge waste is substantially reduced.

Example 1 (Comparative)

Three solution layers were coated onto a blue tinted polyethylene terephthalate substrate (6.8 mils thick, 28 inches wide) with the preferred slide set-up as described, with a slide angle S (see FIG. 4) of 25° and a position angle P of −7°. (The second fluid slot 48 was not required.) The slide set-up used is shown below in Table A-1.

TABLE A-1

| Layer | Slot Height, mil | Slot Step, mil | Slide Angle S, ° | Position Angle P, ° |
|---|---|---|---|---|
| 80 | 5 | 0 | 25 | −7 |
| 84 | 25 | 60 | | |
| 86 | 25 | 60 | | |

The first layer 80 is a primer layer 16 (shown in FIG. 1) and is a solution of Vitel™ PE2200 in MEK at 16.7% solids. It increases adhesion of the photothermographic emulsion layer 14 to the substrate 18. The second layer 84 is a photothermographic emulsion layer 14 (shown in FIG. 1). The third layer 86 is a topcoat layer 12 (shown in FIG. 1). Layer 82 shown in FIG. 2 is not present in this example. The solution properties for the three coating layers are detailed in Table A-2, shown below. The reported value of viscosity is as measured by a Brookfield viscometer, at shear rate of approximately 1.0 $s^{-1}$, and the density is from a % solids vs. density curve for each of the layer formulations.

TABLE A-2

| Layer | % solids | Viscosity, cP | Density, $g/cm^3$ | Wet Thickness W, $\mu m$ |
|---|---|---|---|---|
| 80 | 16.7 | 10 | 0.86 | 5 |
| 84 | 37.0 | 1250 | 0.92 | 70.8 |
| 86 | 14 | 1010 | 0.85 | 22.8 |

Coating was carried out at 100 feet per minute at a coating gap G of 10 mil from the back-up roller and an applied vacuum of 0.1 inch of $H_2O$ across the coating bead. Strikethrough was observed on the side surface 53 resulting in streaking and unacceptable coating quality.

Example 2 (Comparative)

Four solution layers were coated onto a clear polyethylene terephthalate substrate (2 mils thick, 8.5 inches wide) with the preferred slide set-up as described, with a slide angle S (see FIG. 4) of 25° and a position angle P of −7°. The slide set-up used is shown below in Table B-1.

TABLE B-1

| Layer | Slot Height, mil | Slot Step, mil | Slide Angle S, ° | Position Angle P, ° |
|---|---|---|---|---|
| 80 | 5 | 0 | 25 | −7 |
| 82 | 5 | 0 | | |
| 84 | 20 | 60 | | |
| 86 | 15 | 60 | | |

The first two layers 80 and 82 comprise the primer layer 16 (shown in FIG. 1). Layer 80 is a solution of Vitel™ PE2200 resin in MEK at 14.7% solids. Layer 82 is also a solution of Vitel™ PE2200 resin in MEK, but at 30.5% solids. Layer 82 is completely miscible with Layer 80. The third layer 84 is a representative photothermographic emulsion layer 14 (shown in FIG. 1). It was prepared as described below in Table B-3. Its density is greater than Layer 82 as described below in Table B-2. This emulsion layer does not contain developers, stabilizers, antifoggants, etc.; but it is otherwise identical to photothermographic emulsion layers used to produce photothermographic imaging materials. The fourth layer 86 is a topcoat layer 12 (shown in FIG. 1). The solution properties for the four coating layers are detailed in Table B-2, shown below. The reported value of viscosity is as measured by a Brookfield viscometer, at shear rate of approximately 1.0 $s^{-1}$, and the density is from a % solids vs. density curve for each of the layer formulations.

TABLE B-2

| Layer | % solids | Viscosity, cP | Density, $g/cm^3$ | Wet Thickness W, $\mu m$ |
|---|---|---|---|---|
| 80 | 14.7 | 12 | 0.85 | 5.0 |
| 82 | 30.5 | 144 | 0.91 | 5.0 |
| 84 | 31.7 | 1086 | 0.92 | 71.7 |
| 86 | 14.6 | 1300 | 0.86 | 19.3 |

Coating was carried out at 100 fpm at a coating gap G of 10 mil from the back-up roller and at an applied vacuum of 1.0 inch of $H_2O$ across the coating bead. Strikethrough was observed on the slide surface resulting in streaking and unacceptable coating quality.

TABLE B-3

Composition of Photothermographic Emulsion Layer 84

| Premix | Chemical Name | Wt. % |
|---|---|---|
| A | Silver Homogenate | 69.52 |
| B | Methanol | 4.21 |
| C | MEK | 9.72 |
| D | Butvar ™ B-79 | 16.55 |

Example 3

Four solution layers were coated onto a blue tinted polyethylene terephthalate substrate (6.8 mils thick, 28 inches wide) with the preferred slide set-up as described, with a slide angle S (see FIG. 4) of 25° and a position angle P of −7°. The slide set-up used is shown below in Table C-1.

TABLE C-1

| Layer | Slot Height, mil | Slot Step, mil | Slide Angle S, ° | Position Angle P, ° |
|---|---|---|---|---|
| 80 | 5 | 0 | 25 | −7 |
| 82 | 15 | 0 | | |
| 84 | 25 | 60 | | |
| 86 | 25 | 60 | | |

As before, the first two layers 80 and 82 comprise the primer layer 16 (shown in FIG. 1). Layer 80 is a solution of Vitel™ PE2200 resin in MEK at 16.7% solids. Layer 82 is also a solution of Vitel™ PE2200 resin in MEK, but at 42.7% solids. Layer 82 is completely miscible with Layer 80. The third layer 84 is a photothermographic emulsion layer 14 (shown in FIG. 1). As shown in Table C-2, its density is less than that of Layer 82. The fourth layer 86 is a topcoat layer 12 (shown in FIG. 1). The solution properties for the four coating layers are detailed in Table C-2, shown below. The reported value of viscosity is as measured by a Brookfield viscometer, at shear rate of approximately 1.0 $s^{-1}$, and the density is from a % solids vs. density curve for each of the layer formulations.

TABLE C-2

| Layer | % solids | Viscosity, cP | Density, $g/cm^3$ | Wet Thickness W, $\mu m$ |
|---|---|---|---|---|
| 80 | 16.7 | 10 | 0.86 | 5 |
| 82 | 42.7 | 1400 | 0.96 | 7.5 |
| 84 | 37.0 | 1250 | 0.92 | 70.8 |
| 86 | 14 | 1010 | 0.85 | 22.8 |

Coating was carried out at 100 feet per minute at a coating gap G of 10 mil from the back-up roller and an applied vacuum of 0.1 inch of $H_2O$ across the coating bead. No strikethrough was observed on the slide surface and excellent coating quality was achieved.

Example 4

Four solution layers were coated onto a blue tinted polyethylene terephthalate substrate (6.8 mils thick, 28 inches wide) with the preferred slide set-up as described, with a slide angle S (see FIG. 4) of 25° and a position angle P of −7°. The slide set-up used is shown below in Table D-1.

TABLE D-1

| Layer | Slot Height, mil | Slot Step, mil | Slide Angle S, ° | Position Angle P, ° |
|---|---|---|---|---|
| 80 | 5 | 0 | 25 | −7 |
| 82 | 15 | 0 | | |
| 84 | 25 | 60 | | |
| 86 | 25 | 60 | | |

As before, the first two layers 80 and 82 comprise the primer layer 16 (shown in FIG. 1). Layer 80 is a solution of Vitel™ PE2200 resin in MEK at 14.0% solids. Layer 82 is also a solution of PE2200 resin in MEK, but at 33.0% solids. Layer 82 is completely miscible with Layer 80. The third layer 84 is a photothermographic emulsion layer 14 (shown in FIG. 1). As shown below in Table D-2, its density is equal to that of Layer 82. The fourth layer 86 is a topcoat layer 12 (shown in FIG. 1). The solution properties for the four coating layers are detailed below in Table D-2. The reported value of viscosity is as measured by a Brookfield viscometer, at shear rate of approximately 1.0 $s^{-1}$, and the density is from a % solids vs. density curve for each of the layer formulations.

TABLE D-2

| Layer | % solids | Viscosity, cP | Density, g/cm$^3$ | Wet Thickness W, $\mu$m |
|---|---|---|---|---|
| 80 | 14.0 | 7.5 | 0.85 | 5.0 |
| 82 | 33.0 | 300 | 0.92 | 1.5 |
| 84 | 37.3 | 1200 | 0.92 | 72.8 |
| 86 | 13.7 | 950 | 0.85 | 22.6 |

Coating was carried out at 100 feet per minute at a coating gap G of 10 mil from the back-up roller and an applied vacuum of 0.5 inch of $H_2O$ across the coating bead. No strikethrough was observed on the slide surface and excellent coating quality was attained.

Example 5

Four solution layers were coated onto a blue tinted polyethylene terephthalate substrate (6.8 mils thick, 28 inches wide) with the preferred slide set-up as described, with a slide angle S (see FIG. 4) of 25° and a position angle P of −7°. The slide set-up used is shown below in Table E-1.

TABLE E-1

| Layer | Slot Height, mil | Slot Step, mil | Slide Angle S, ° | Position Angle P, ° |
|---|---|---|---|---|
| 80 | 5 | 0 | 25 | −7 |
| 82 | 15 | 0 | | |
| 84 | 25 | 60 | | |
| 86 | 25 | 60 | | |

As before, the first two layers 80 and 82 comprise the primer layer 16 (shown in FIG. 1). Layer 80 is a solution of Vitel™ PE2200 resin in MEK at 10.6% solids. Layer 82 is also a solution of Vitel™ PE2200 resin in MEK, at 43.2% solids. Layer 82 is completely miscible with Layer 80. The third layer 84 is a photothermographic emulsion layer 14 (shown in FIG. 1). As shown in Table E-2, its density is less than that of Layer 82. The fourth layer 86 is a topcoat layer 12 (shown in FIG. 1). The solution properties for the four coating layers are shown below in Table E-2. The reported value of viscosity is as measured by a Brookfield viscometer, at shear rate of approximately 1.0 $s^{-1}$, and the density is from a % solids vs. density curve for each of the layer formulations.

TABLE E-2

| Layer | % solids | Viscosity, cP | Density, g/cm$^3$ | Wet Thickness W, $\mu$m |
|---|---|---|---|---|
| 80 | 10.6 | 4 | 0.84 | 2.1 |
| 82 | 43.2 | 1775 | 0.96 | 2.5 |
| 84 | 35.1 | 1200 | 0.92 | 73.3 |
| 86 | 13.7 | 925 | 0.85 | 21.5 |

Coating was carried out at 100 feet per minute at a coating gap G of 50 mil from the back-up roller and an applied vacuum of 0.7 inch of $H_2O$ across the coating bead. No strikethrough was observed on the slide surface, and excellent coating quality resulted.

Example 6

Three solution layers were coated onto a blue tinted polyethylene terephthalate substrate (6.8 mils thick, 28 inches wide) with the preferred slide set-up as described, with a slide angle S (see FIG. 4) of 25° and a position angle P of −7°. The slide set-up used is shown below in Table F-1.

TABLE F-1

| Layer | Slot Height, mil | Slot Step, mil | Slide Angle S, ° | Position Angle P, ° |
|---|---|---|---|---|
| 80 | 5 | 0 | 25 | −7 |
| 84 | 25 | 30 | | |
| 86 | 25 | 30 | | |

Layer 80 is a primer layer 16 (shown in FIG. 1) and comprises a solution of Pentalyn-H resin in MEK at 50.0% solids. The second layer 84 is a photothermographic emulsion layer 14 (shown in FIG. 1). The densities of solutions 80 and 84 are equal. The third layer 86 is a topcoat layer 12 (shown in FIG. 1). The solution properties for the three coating layers are detailed in Table F-2, shown below. The reported value of viscosity is as measured by a Brookfield viscometer, at shear rate of approximately 1.0 $s^{-1}$, and the density is from a % solids vs. density curve for each of the layer formulations.

TABLE F-2

| Layer | % solids | Viscosity, cP | Density, g/cm$^3$ | Wet Thickness W, $\mu$m |
|---|---|---|---|---|
| 80 | 50.0 | 5 | 0.92 | 9.6 |
| 84 | 37.3 | 1350 | 0.92 | 70.9 |
| 86 | 14 | 1010 | 0.85 | 21.7 |

Coating was carried out at 75 feet per minute at a coating gap G of 10 mil from the back-up roller and an applied vacuum of 0.1 inch of $H_2O$ across the coating bead. No strikethrough was observed on the slide surface and excellent coating quality was achieved.

Example 7

Three solution layers were coated onto a blue tinted polyethylene terephthalate substrate (6.8 mils thick, 28 inches wide) with the preferred slide set-up as described, with a slide angle S (see FIG. 4) of 25° and a position angle P of −7°. This substrate had an antihalation back coat incorporating an antihalation dye. The slide set-up used is shown below in Table G-1.

TABLE G-1

| Layer | Slot Height, mil | Slot Step, mil | Slide Angle S, ° | Position Angle P, ° |
|---|---|---|---|---|
| 80 | 5 | 0 | 25 | −7 |
| 84 | 25 | 60 | | |
| 86 | 25 | 60 | | |

The dried photothermographic element resulting from this coating does not contain a primer layer. The first and second layers 80 and 84 comprise a photothermographic emulsion layer 14 (shown in FIG. 1). Layer 84 was prepared substantially as described in U.S. Pat. No. 5,541,054. Layer 80 was subsequently diluted from this solution to a lower % solids. The third layer 86 is a topcoat layer 12 (shown in FIG. 1). It has a density lower than that of layer 84. The solution properties for the three coating layers are detailed in Table G-2, shown below. The reported value of viscosity is as measured by a Brookfield viscometer, at shear rate of approximately 1.0 $s^{-1}$, and the density is from a % solids vs. density curve for each of the layer formulations.

TABLE G-2

| Layer | % solids | Viscosity, cP | Density, g/cm$^3$ | Wet Thickness W, $\mu$m |
|---|---|---|---|---|
| 80 | 12.0 | 7.5 | 0.84 | 5.0 |
| 84 | 37.4 | 1025 | 0.93 | 72.3 |
| 86 | 13.7 | 888 | 0.85 | 21.6 |

Coating was carried out at 75 feet per minute at a coating gap G of 10 mil from the back-up roller and an applied vacuum of 0.4 inch of $H_2O$ across the coating bead. Note that in this example, the first carried layer, self-cleanable by the carrier layer, is of 72.3 $\mu$m thickness. No strikethrough was observed on the slide surface and excellent coating quality was achieved.

Example 8

Four solution layers were coated onto a blue tinted polyethylene terephthalate substrate (6.8 mils thick, 28 inches wide) with the preferred slide set-up as described, with a slide angle S (see FIG. 4) of 25° and a position angle P of −7°. The slide set-up used is shown below in Table H-1.

TABLE H-1

| Layer | Slot Height, mil | Slot Step, mil | Slide Angle S, ° | Position Angle P, ° |
|---|---|---|---|---|
| 80 | 5 | 0 | 25 | −7 |
| 82 | 15 | 0 | | |
| 84 | 25 | 60 | | |
| 86 | 25 | 60 | | |

As above, the first two layers 80 and 82 comprise the primer layer 16 (shown in FIG. 1). Layer 80 is a solution of Vitel™ PE2200 resin in MEK at 14.0% solids. Layer 82 is also a solution of Vitel™ PE2200 resin in MEK, but at 40.3% solids. The third layer 84 comprises a photothermographic emulsion layer 14 (shown in FIG. 1). The fourth layer 86 is a topcoat layer 12 (shown in FIG. 1). The solution properties for the four coating layers are detailed in Table H-2, shown below. The reported value of viscosity is as measured by a Brookfield viscometer, at shear rate of approximately 1.0 $s^{-1}$, and the density is from a % solids vs. density curve for each of the layer formulations.

TABLE H-2

| Layer | % solids | Viscosity, cP | Density, g/cm$^3$ | Wet Thickness W, $\mu$m |
|---|---|---|---|---|
| 80 | 14 | 7.5 | 0.85 | 5.0 |
| 82 | 40.3 | 1120 | 0.95 | 2.5 |
| 84 | 37.1 | 1120 | 0.92 | 71.8 |
| 86 | 12.7 | 1300 | 0.83 | 20.1 |

Coating was carried out at line speeds ranging from 100 feet per minute at a coating gap G of 10 mil from the back-up roller and an applied vacuum of 1.2 inches of $H_2O$ across the coating bead to 500 feet per minute at a coating gap G of 10 mil and an applied vacuum level of 2.5 inches of $H_2O$. No strikethrough was observed on the slide surface at any speed and excellent coating quality was achieved.

Example 9

The following example demonstrates that increased thickness of the first carried layer can slow penetration of further carried layers and prevent strikethrough.

The solutions prepared as described in Example 2 (Comparative) were coated onto a clear polyethylene terephthalate substrate (2 mils thick, 8.5 inches wide) as described in Example 2 except that the wet thickness of layer 82 was increased from 5 $\mu$m to 17 $\mu$m. Coating was carried out at 100 fpm at a coating gap G of 10 mil from the back-up roller and at an applied vacuum of 1.0 inch of $H_2O$ across the coating bead. No strikethrough was observed on the slide surface and excellent coating quality was achieved.

Example 10

Example 7 was repeated using pure MEK fed through slot 46. This example demonstrates the use of pure organic solvent as a carrier layer. The minimal strikethrough that was observed on the slide surface was quickly self-cleaned and excellent coating quality was achieved.

Example 11

Three solution layers were coated onto a blue tinted polyethylene terephthalate substrate (6.8 mil thick, 28 inches wide) with the preferred slide set-up as described, with a slide angle S (see FIG. 4) of 25° and a position angle P of −7°. All the slots were of constant slot height across the full width. This substrate had an antihalation back coat incorporating an antihalation dye. The slide set-up used is shown below in Table I-1.

TABLE I-1

| Layer | Slot Height, mil | Slot Step, mil | Slide Angle S, ° | Position Angle P, ° |
|---|---|---|---|---|
| 80 | 5 | 0 | 25 | −7 |
| 84 | 25 | 60 | | |
| 86 | 25 | 60 | | |

The dried photothermographic element resulting from this coating did not contain a primer layer. As before, the first and second layers 80 and 84 comprise a photothermographic emulsion layer 14 (shown in FIG. 1). Layer 84 was prepared substantially as described in U.S. Pat. No. 5,541,054. Layer 80 was subsequently diluted from this solution to a lower % solids. The third layer 86 is a topcoat layer 12 (shown in FIG. 1). The solution properties for the three coating layers are shown below in Table I-2. The reported value of viscosity is as measured by a Brookfield viscometer, at shear rate of approximately 1.0 $s^{-1}$ and the density is from a % solids vs. density curve for each of the layer formulations.

TABLE I-2

| Layer | % solids | Viscosity, cP | Density, g/cm$^3$ | Wet Thickness W, $\mu$m |
|---|---|---|---|---|
| 80 | 10.99 | 6 | 0.83 | 5 |
| 84 | 36.7 | 1375 | 0.92 | 66.4 |
| 86 | 13.51 | 1400 | 0.85 | 23.91 |

Figure 15:
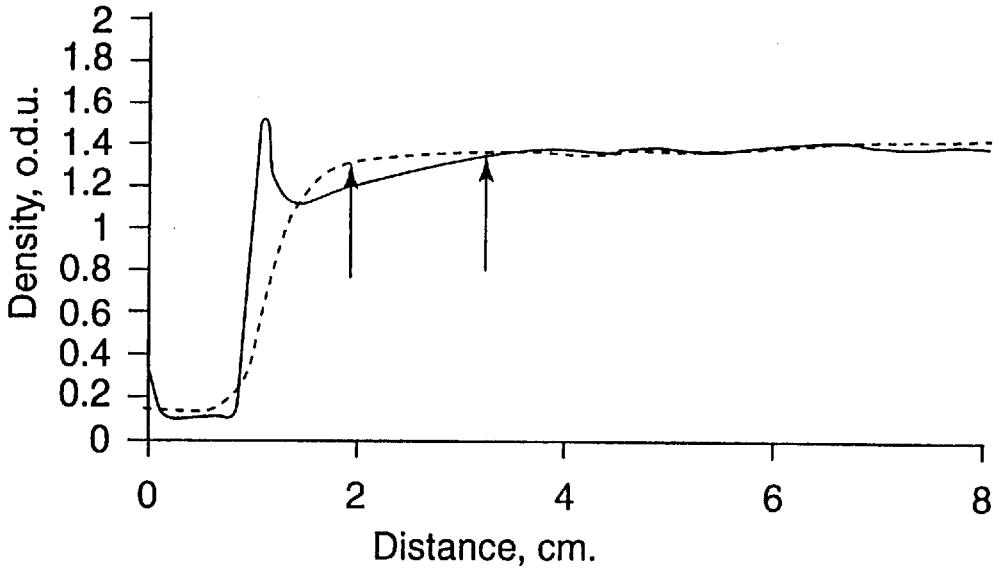
FIG. 15 is a plot of the optical density profile.

Coating was carried out at 70 feet per minute at a coating gap G of 10 mil from the back-up roller and an applied vacuum of 0.8 inch of $H_2O$ across the coating bead. The optical density profile obtained with this conventional slot arrangement is shown in FIG. 15. As seen, a heavy edge bead results and an edge waste of about 3.5 cm is created (before uniform coating weight is achieved).

Example 12

Three solution layers were coated onto a blue tinted polyethylene terephthalate substrate (6.8 mil thick, 28 inches wide). This substrate had an antihalation back coat incorporating an antihalation dye. The preferred slide set-up was used, as described, with a slide angle S (see FIG. 4) of 25° and a position angle P of −7°. The slot height of slot 50 (see FIG. 4) was modified with the help of a wedge-shaped shim to result in a slot shape described above in FIGS. 11 and 12, with W=25 inches and V=24.5 inches. The slot heights for the other slots were constant over their entire length. The slide set-up used is shown below in Table J-1.

TABLE J-1

| Layer | Slot Height, mil | Slot Step, mil | Slide Angle S, ° | Position Angle P, ° |
|---|---|---|---|---|
| 80 | 5 | 0 | 25 | −7 |
| 84 | 25 | 60 | | |
| 86 | 25 | 60 | | |

The dried photothermographic element resulting from this coating did not contain a primer layer. As before, the first and second layers 80 and 84 comprised a photothermographic emulsion layer 14 (shown in FIG. 1). Layer 84 was prepared substantially as described in U.S. Pat. No. 5,541,054. Layer 80 was subsequently diluted from this solution to a lower % solids. The third layer 86 is a topcoat layer 12 (shown in FIG. 1). The solution properties for the three coating layers are shown below in Table J-2. The reported value of viscosity is as measured by a Brookfield viscometer, at shear rate of approximately 1.0 $s^{-1}$ and the density is from a % solids vs. density curve for each of the layer formulations.

TABLE J-2

| Layer | % solids | Viscosity, cP | Density, g/cm$^3$ | Wet Thickness W, $\mu$m |
|---|---|---|---|---|
| 80 | 9.13 | 6 | 0.82 | 5 |
| 84 | 35.61 | 1581 | 0.92 | 71.9 |
| 86 | 14.75 | 2000 | 0.85 | 25.9 |

Coating was carried out at 70 feet per minute at a coating gap G of 10 mil from the back-up roller and an applied vacuum of 0.5 inch of $H_2O$ across the coating bead. The optical density profile obtained with this chamfered slot arrangement is shown by the dashed line in the plot shown above, which is entitled "Comparison of Edge Profile With Constant Shim Height Vs. Chamfered Shim Height." As seen, the heavy edge bead is virtually eliminated (replaced with a relatively immediate monotonic rise in thickness, and, therefore, in optical density) which results in (a) reduced edge waste, in one case from about 3.5 cm to about 2 cm, (b) reduced inadvertent coating of idler rollers with a coating fluid, a.k.a. "pick-off," and (c) reduced hardbanding.

Reasonable modifications and variations are possible from the foregoing disclosure without departing from either the spirit or scope of the present invention as defined by the claims. For example, the invention is applicable to fluid systems other than the imaging systems described herein. One such fluid system is one used in the manufacture of data storage media or elements (e.g., magnetic computer tape, floppy or rigid disks or diskettes, and the like). Another such fluid system can be one used in the manufacture of another form of imaging media (e.g., thermographic, photographic, and still other forms of imaging media or elements). A variety of other fluid systems (e.g., for photoresist elements) which can benefit by multi-layer coating techniques will benefit from the present invention.

We claim:

1. A method for use with a slide coater capable of flowing at least a first coating fluid over a first slide surface and onto a substrate, comprising the step of:

flowing a slide-treating fluid down the first slide surface when the first fluid coating is not flowed onto the substrate, wherein the slide-treating fluid does not substantially contact the substrate, the slide-treating fluid having a composition which reduces drying of the first coating fluid on the first slide surface; wherein when the first coating fluid is flowed, the first coating fluid flows out of a first slot adjacent the first slide surface such that the first coating fluid flows out of the first slot and down the first slide surface; and wherein the step flowing the slide-treating fluid comprises flowing the slide-treating fluid out of a second slot adjacent a second slide surface, the second slide surface being positioned relative to the first slide surface such that the slide-treating fluid flows down the second slide surface before flowing down the first slide surface.

2. The method of claim 1, further comprising the step of flowing a first coating fluid down the first slide surface and onto the substrate, the step of flowing the slide-treating fluid occurring before the step of flowing the first coating fluid.

3. The method of claim 1, further comprising the steps of starting and stopping flow of a first coating fluid onto the substrate, the step of flowing the slide-treating fluid occurring after stopping the flow of the first coating fluid onto the substrate.

4. The method of claim 1, further comprising the steps of starting and stopping flow of a first coating fluid onto the substrate, the step of flowing the slide-treating fluid occurring before the first coating fluid is coated onto the substrate, the step of flowing the slide-treating fluid stopping after the step of flowing the first coating fluid is started, and the step of flowing the slide-treating fluid occurring again before the step of flowing the first coating fluid is stopped.

5. The method of claim 1, further comprising the step of flowing a first coating fluid at a first volumetric flow rate when the flowing of the first coating fluid onto the substrate is desired, the method further comprising the step of reducing the flowing of the first coating fluid to below the first volumetric rate when the first coating fluid is not flowed onto the substrate.

6. The method of claim 5, the reducing step comprising stopping the flowing of the first coating fluid.

7. The method of claim 5, further comprising the steps of:

increasing the flowing of the first coating fluid to approximately the first volumetric rate after the reducing step when resuming the coating of the first coating fluid onto the substrate is desired; and reducing the flowing of the slide-treating fluid down the at least first slide surface when the increasing step occurs.

8. The method of claim 7, the step of reducing the flowing of the slide-treating fluid comprising stopping the flowing of the slide-treating fluid.

9. The method of claim 1, further comprising the step of flowing a first coating fluid down the first slide surface and onto the substrate, the first coating fluid comprising a first solute and at least a first solvent, the slide-treating fluid comprising the first solvent.

10. The method of claim 1, a second slide surface being positioned relative to the first slide surface, the step of flowing the slide-treating fluid comprising flowing the slide-treating fluid down the second slide surface before the slide-treating fluid flows down the first slide surface, the method further comprising the steps of:

flowing a first coating fluid down the first slide surface;

preparing at least one additional coating fluid for being coated onto the substrate; and flowing the at least one additional coating fluid down an at least one additional slide surface of the slide coater when coating of the at least one additional coating fluid onto the substrate is desired, the at least one additional slide surface being positioned between the first slide surface and the second slide surface such that the slide-treating fluid flows down the at least one additional slide surface to reduce the drying of the at least one additional coating fluid on the at least one additional slide surface.

11. The method of claim 1, further comprising the step of flowing a first coating fluid down the first slide surface and onto the substrate, wherein the first fluid comprises a precursor for an imaging element.

12. The method of claim 1, further comprising the step of flowing a first coating fluid down the first slide surface and onto the substrate, wherein the first fluid comprises a precursor for a data storage element.

13. The method of claim 1, wherein the step of flowing the slide-treating fluid removes debris on the at least first slide surface.

14. The method of claim 1, further comprising the step of flowing a first coating fluid down the at least first slide surface and onto the substrate, wherein the step of flowing the slide-treating fluid pre-wets the first slide surface before the step of flowing the first coating fluid down the first slide surface.

15. The method of claim 1, further comprising the step of flowing a first coating fluid from a first slot and onto the first slide surface, wherein the slide-treating fluid does not emanate from the first slot.

16. A method for using a slide coater, comprising the steps of:

providing a first slide surface of the slide coater;

providing a substrate adjacent the first slide surface;

transporting the substrate past the first slide surface;

starting flow of a first coating fluid down the first slide surface and onto the substrate such that the first coating fluid coats the substrate;

stopping the flow of the first coating fluid onto the substrate;

starting flow of a slide-treating fluid down the first slide surface approximately when the flow of the first coating fluid onto the substrate is stopped, the slide-treating fluid substantially avoiding contact with the substrate;

resuming the flow of the first coating fluid onto the substrate; and stopping the flowing of slide-treating fluid approximately when the flow of the first coating fluid onto the substrate is resumed such that the slide-treating fluid substantially avoids contact with the substrate.

17. The method of claim 16, the slide coater having a first slot adjacent the first slide surface, the first coating fluid flowing through the first slot before flowing onto the first slide surface, the slide-treating fluid not emanating from and flowing through the first slot.

18. A method for using a slide coater to form a particular coated substrate, comprising the steps of:

positioning a first slide surface of the slide coater and a second slide surface of the slide coater adjacent the first slide surface;

transporting a substrate adjacent the first slide surface;

starting flow of a first coating fluid down the first slide surface and onto the substrate at a first volumetric flow rate such that the first coating fluid coats the substrate;

starting flow of at least a second coating fluid down the second slide surface and onto the first coating fluid at a second volumetric flow rate when the first coating fluid flows on the first slide surface and onto the substrate, the first and at least second coating fluids on the substrate forming a particular coated substrate;

reducing the flow of at least one of the first coating fluid and the at least second coating fluid onto the substrate to a reduced volumetric flow rate, wherein the reduced volumetric flow rate can equal no volumetric flow;

starting flow of a slide-treating fluid down the first and second slide surfaces approximately when the flow of the at least one of the first coating and the at least second coating fluid onto the substrate is reduced, the slide-treating fluid substantially avoiding contact with the particular coated substrate;

increasing the reduced flow such that the first coating fluid flows onto the substrate at the first volumetric flow rate and the at least second coating fluid flows onto the substrate at the second volumetric flow rate; and stopping the flow of slide-treating fluid approximately when the flow of the first coating fluid and the at least second coating fluid onto the moving substrate is resumed such that formation of the particular coated substrate is resumed and such that the slide-treating fluid substantially avoids contact with the particular coated substrate.

19. The method of claim 18, the slide coater having a first slot adjacent the first slide surface and at least a second slot adjacent the at least second slide surface, the first coating fluid flowing through the first slot before flowing onto the first slide surface, the second coating fluid flowing through the second slot before flowing onto the second slide surface, the slide-treating fluid not emanating from and flowing through the first slot or the second slot.

* * * * *